US006577816B2

(12) United States Patent
Grob et al.

(10) Patent No.: US 6,577,816 B2
(45) Date of Patent: Jun. 10, 2003

(54) INFRARED RADIATION SYSTEM WITH MULTIPLE IR RADIATORS OF DIFFERENT WAVELENGTH

(75) Inventors: Siegfried Grob, Maintal (DE); Joachim Scherzer, Bruchköbel (DE); Klaus Schmitz, Hanau (DE); Walter Dieudonné, Kleinostheim (DE)

(73) Assignee: Heraeus Noblelight GmbH, Hanau (DE)

( * ) Notice: Subject to any disclaimer, the term of this patent is extended or adjusted under 35 U.S.C. 154(b) by 0 days.

(21) Appl. No.: 10/074,316

(22) Filed: Feb. 12, 2002

(65) Prior Publication Data

US 2002/0094197 A1 Jul. 18, 2002

Related U.S. Application Data

(62) Division of application No. 09/859,788, filed on May 17, 2001, now Pat. No. 6,421,503.

(30) Foreign Application Priority Data

May 22, 2000 (DE) ..... 100 24 963

(51) Int. Cl.[7] ..... H05B 3/00

(52) U.S. Cl. ..... 392/407; 219/477; 219/479; 250/495.1; 250/504 R; 313/111

(58) Field of Search ..... 392/407, 411; 219/553, 477, 479, 539, 548, 551; 313/578, 579–580, 316; 250/495.1, 504 R; 362/231, 234; 34/266

(56) References Cited

U.S. PATENT DOCUMENTS 2,346,234 A * 4/1944 Reynolds ..... 219/553
3,627,989 A * 12/1971 Heidler et al. ..... 219/553
4,091,441 A * 5/1978 Ott ..... 362/231
4,575,616 A * 3/1986 Bergendal ..... 219/405
5,091,632 A 2/1992 Hennecke et al.
5,261,165 A * 11/1993 Tate ..... 34/266
5,889,367 A 3/1999 Hofmann et al.
5,930,914 A * 8/1999 Johansson et al. ..... 34/273
6,122,438 A 9/2000 Scherzer et al.

FOREIGN PATENT DOCUMENTS

| | | |
|---|---|---|
| DE | 1807660 | 12/1959 |
| DE | 1925033 | 11/1969 |
| DE | 4438871 | 5/1996 |

(List continued on next page.)

OTHER PUBLICATIONS

DE–Z: Pautz, J., Scherg, P., "Zur Auslegung von kombinierten Strahlungs–Konvektions–Trocknern", Elektowärme International 46, Aug. 1988, B201 bis.

*Primary Examiner*—John A. Jeffery
(74) *Attorney, Agent, or Firm*—Fulbright & Jaworski L.L.P.

(57) ABSTRACT

A radiation system has at least two elongated envelope tubes permeable to light and infrared radiation which are joined together and sealed from the ambient atmosphere, a first envelope tube of which contains an incandescent coil which is electrically connected through sealed tube ends and external contacts to an external power supply and emits infrared radiation in the near IR range; furthermore, at least a second envelope tube is provided which has an elongated carbon strip as an infrared radiator for radiation in the medium IR range, which is likewise connected through sealed ends and external contacts with the external power supply or with an additional external power supply. Preferably a carbon strip is used as the radiator strip, which is configured either as an elongated coil or forms an elongated strip. It is thus possible to produce both infrared radiation in the near IR range and infrared radiation in the medium IR range, so that in the case, for example, of the surface application of paints both paint pigments and pigment solvents can be rapidly vaporized and dried.

4 Claims, 10 Drawing Sheets

FOREIGN PATENT DOCUMENTS

| | | | |
|---|---|---|---|
| DE | 19613502 | | 10/1997 |
| DE | 19822829 | | 11/1999 |
| DE | 19839457 | | 3/2000 |
| EP | 0428835 | | 5/1991 |
| GB | 1544551 | | 4/1979 |
| JP | 2-118329 | * | 5/1990 |
| JP | 2-152187 | * | 6/1990 |
| JP | 8-107078 | * | 4/1996 |

* cited by examiner

INFRARED RADIATION SYSTEM WITH MULTIPLE IR RADIATORS OF DIFFERENT WAVELENGTH

This a divisional application of Ser. No. 09/859,788 filed May 17, 2001 now U.S. Pat. No. 6,421,503.

The invention relates to a radiation device with at least one infrared radiator and at least one additional radiator with at least two elongated envelope tubes joined together which are permeable to light and infrared radiation and sealed from the ambient atmosphere, at least a first one of which has an incandescent coil filament which is electrically connected with an external power supply through sealed tube ends and external contacts, as well as to its use and a method for the treatment of surfaces.

BACKGROUND AND SUMMARY OF THE INVENTION

The invention relates to a radiation device with at least one infrared radiator and at least one additional radiator with at least two elongated envelope tubes joined together which are permeable to light and infrared radiation and sealed from the ambient atmosphere, at least a first one of which has an incandescent coil filament which is electrically connected with an external power supply through sealed tube ends and external contacts, as well as to its use and a method for the treatment of surfaces.

In GB Patent 1544551 an electrical heat radiator is disclosed which has two heating coils disposed parallel to one another, each being arranged in a quartz glass tube, the quartz glass tubes being connected in their length by fusion. The two incandescent coil filaments are connected in series.

Even though a considerable increase of intensity can be achieved, only a comparatively narrow spectral range of the short-wave infrared radiation is emitted, it being difficult, as a rule, to dry rapidly and simultaneously paints and pigments and their solution for example water after surface application, as for example by printing on a support.

Furthermore, EP 0 428 835 A2 and its corresponding U.S. Pat. No. 5,091,632 also disclose infrared radiators with twin tube radiators.

Furthermore, DE 198 39 457 A1 discloses the use of an infrared radiator with a carbon ribbon as heating element; such a carbon ribbon is suitable especially for the emission of IR radiation in a medium wavelength range of 1.5 to 4.5 $\mu$m.

The invention is addressed to the problem of creating a thermal radiation device in order to dry rapidly coatings or impressions made with pigments or paints in solvents which are applied to surfaces, and at the same time to cause the solvents, such as toluene or water, to evaporate rapidly.

The problem is solved as regards apparatus by the fact that at least a second envelope tube is provided which has a radiating ribbon which is electrically connected to the power supply or to an additional external power supply through sealed ends and external contacts. The second envelope tube is likewise provided for the emission of infrared radiation, especially for the emission of IR radiation in the medium IR range. Of course, a different kind of temperature radiator which emits radiation in the medium IR range can also be used instead of the radiating ribbon. It has proven advantageous for the device to have comparatively great radiation components both in the visible spectral range and in the near infrared radiation range, especially with a wavelength ranging from 780 nm to 1.4 $\mu$m, as well as in the medium IR radiation range from 2.5 $\mu$m to 5 $\mu$m.

In a preferred embodiment of the invention an elongated carbon ribbon is used as the radiating strip, the carbon ribbon being configured as an elongated coil in another preferred embodiment. It emits radiation in a medium IR spectral range, while an incandescent coil radiator emits short-wavelength IR radiation (near IR) and in some cases also visible light.

It proves to be especially advantageous that, by combining radiation sources with different temperatures ($\Delta\lambda$max>400 nm) in a common radiation device, the efficiency of processes for heat treatment can be improved over conventional short-wavelength IR radiation sources. For example, the efficiency of paint drying processes is improved.

On account of its superimposition of different Planck distributions, the radiation device has a greater percentage of IR radiation components than former radiation sources with only one temperature in the stated wavelength ranges.

In another advantageous embodiment, it is possible to provide, in addition to thermal radiation sources, at least one additional elongated tube permeable to light and UV radiation, which has an electrical discharge portion and an additional UV radiation in the wavelength range from 150 nm to 380 nm, which is especially suitable for drying paint.

Preferred embodiments of the infrared radiator and radiation device are disclosed herein.

A special advantage over single radiators is reduced space requirement, and optimum radiation conditions can be created by the selective operation of the radiation sources with different wavelengths that are best for the particular fields of application.

A solution of the problem for a particular application is provided by the use of a twin-tube radiation device with an incandescent coil as the short-wave infrared radiation source and a tube provided with a carbon ribbon for the radiating strip as a medium-wave IR radiator.

The problem is solved, in a method for the treatment of surfaces with IR radiation, wherein especially coated or imprinted surfaces on substrates, or dissolved pigments on a support, are irradiated to dry them, by treating the surface at least for a time with an IR radiation with a high content in a first wavelength range of 780 nm to 1.2 $\mu$m and simultaneously for a time with an IR radiation with a high content in a second wavelength range of 2.5 $\mu$m to 5 $\mu$m.

Advantageous embodiments of the method are disclosed herein.

In a preferred embodiment of the method, the surface radiation of the first wavelength range and of the second wavelength range overlap at least for a time, the first IR radiation being emitted from a radiator with an incandescent coil and the second IR radiation from a carbon ribbon as radiation source. It proves to be especially advantageous for the superimposition of the first and second wavelength ranges to have a spectral radiation distribution with a relatively great content in the wavelength range of 780 nm to 3.1 $\mu$m.

An important advantage is to be seen in the fact that, depending on the embodiment, the individual radiation percentages of this radiation device can be turned on in an OR operation or in a common kind of switching. In the operation of machines with alternating processes, this results in the advantage that radiator alternation need no longer take place. Also, the user no longer needs different individual radiation sources, so that a smaller stock of replacement parts is achieved. Furthermore, the carbon radiator used can be used as a starting current limiter for the short-wave radiator (incandescent coil).

In an additional embodiment, the infrared spectra superimposed on the ultraviolet radiation content. Here, again, separate and common types of operation can be combined.

The subject is further explained below with the aid of FIGS. 1*a*, 1*b*, 1*c*, 2, 3 and 4.

FIG. 1*a* is a perspective schematic view of a twin tube radiator according to the invention.

FIG. 1*b* shows a front elevation of a twin tube radiator which, however, has a coiled carbon radiator.

FIG. 1*c* shows a front elevation of a system which additional has a tubular discharge lamp, so that ultraviolet radiation can be produced in addition to infrared radiation.

Figure 7:
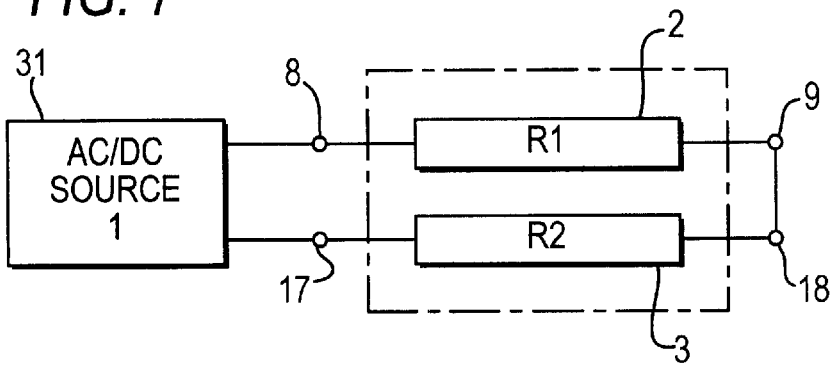
Figure 8:
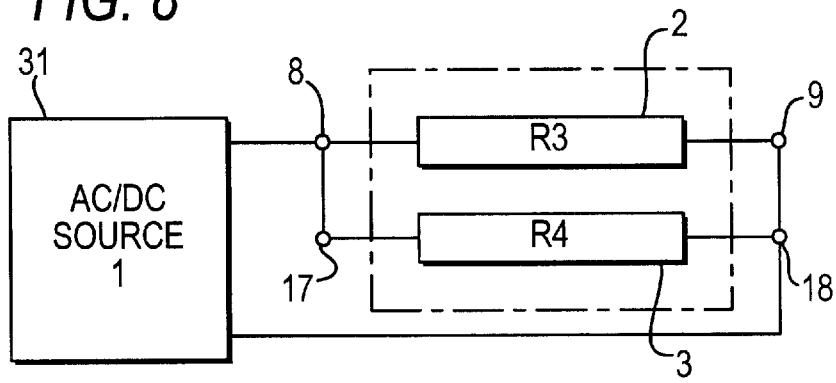
Figure 9:
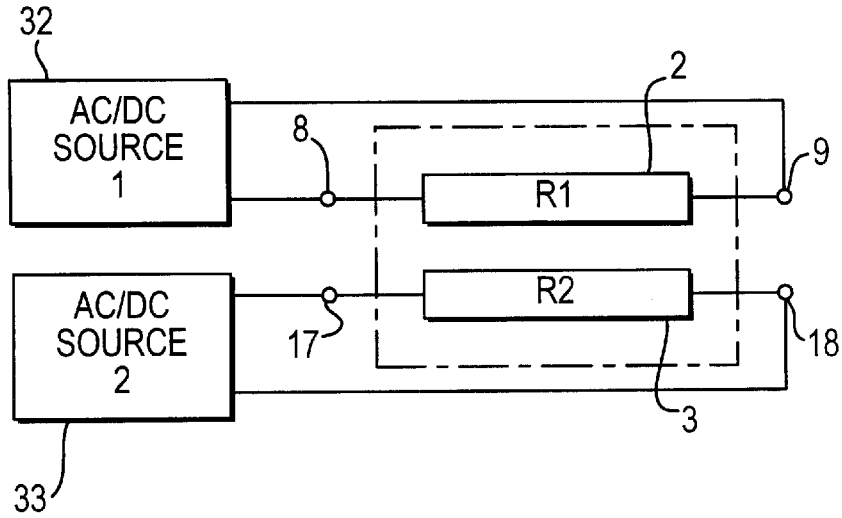

FIGS. 7, 8, and 9 are electrical schematic diagrams showing different embodiments of electrical connections of the twin tube radiator to a power supply according to the FIG. 1.

Figure 10:
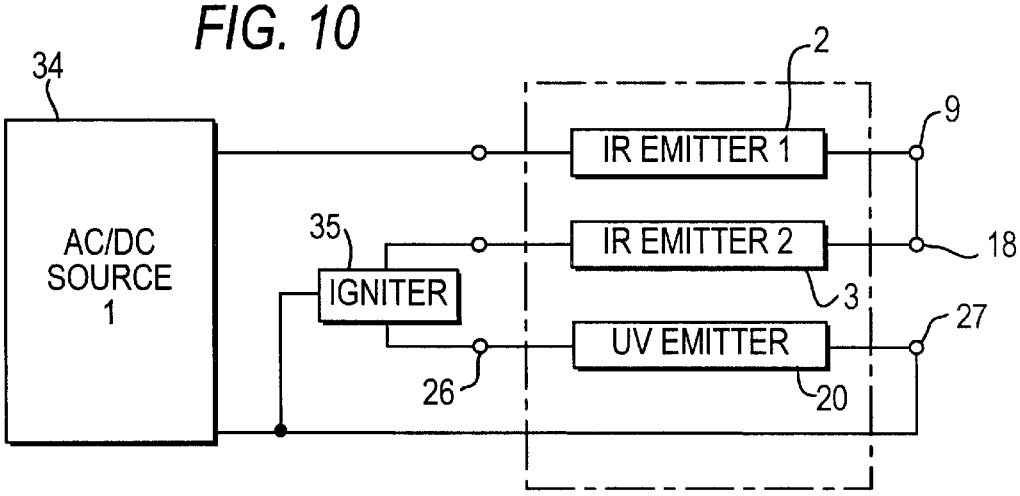
Figure 11:
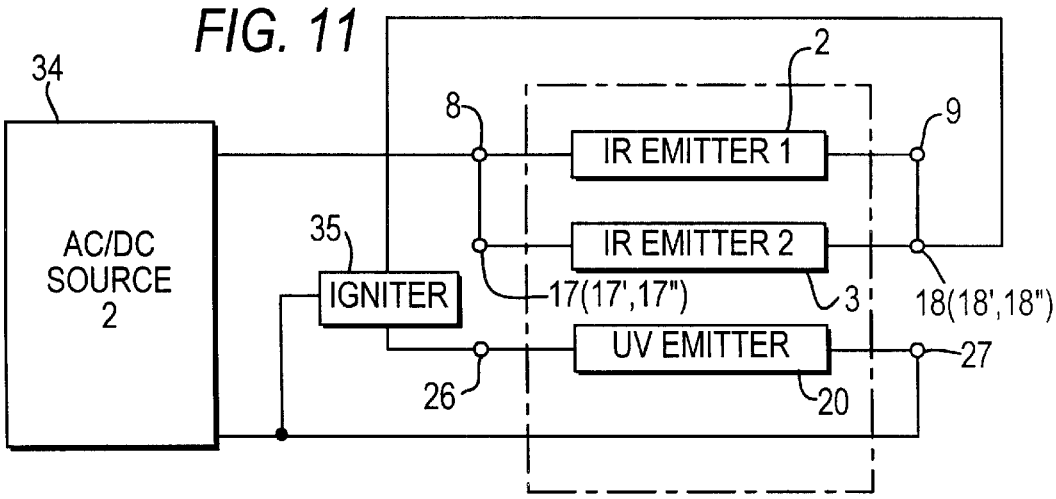
Figure 12:
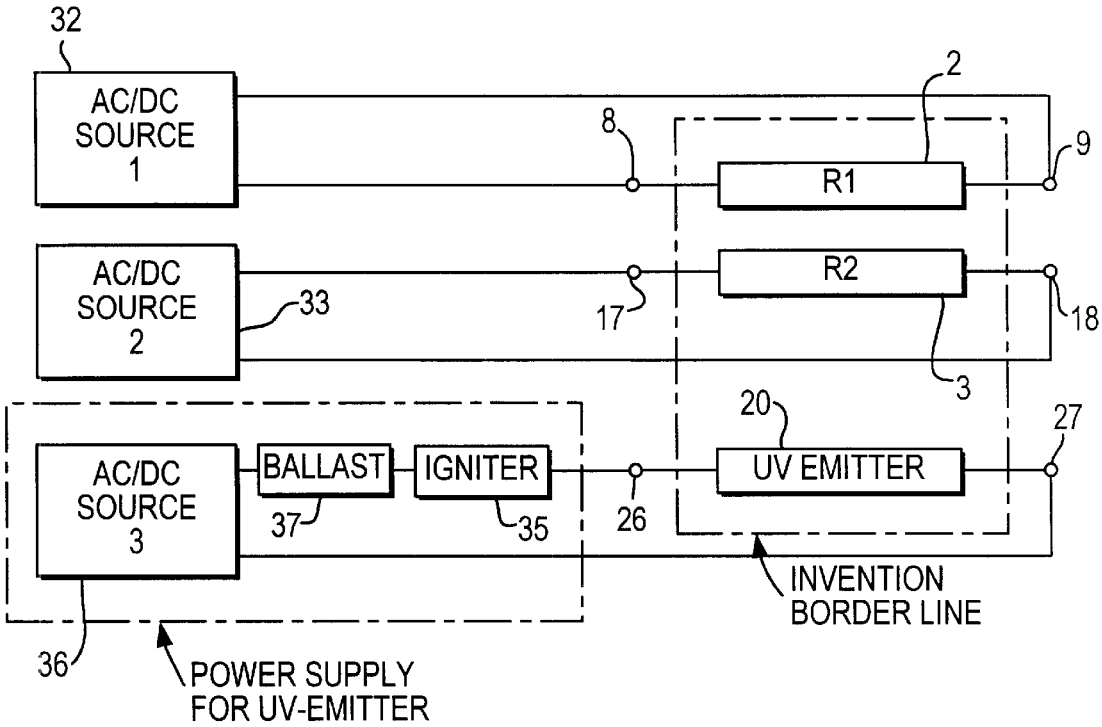

FIGS. 10, 11, and 12 show electrical connections of a triple tube system comprising a twin tube IR radiating system, which additionally has a tubular discharge lamp, so that UV-radiation can be produced in addition to IR-radiation.

DETAILED DESCRIPTION OF PREFERRED EMBODIMENTS

Figure 1A:
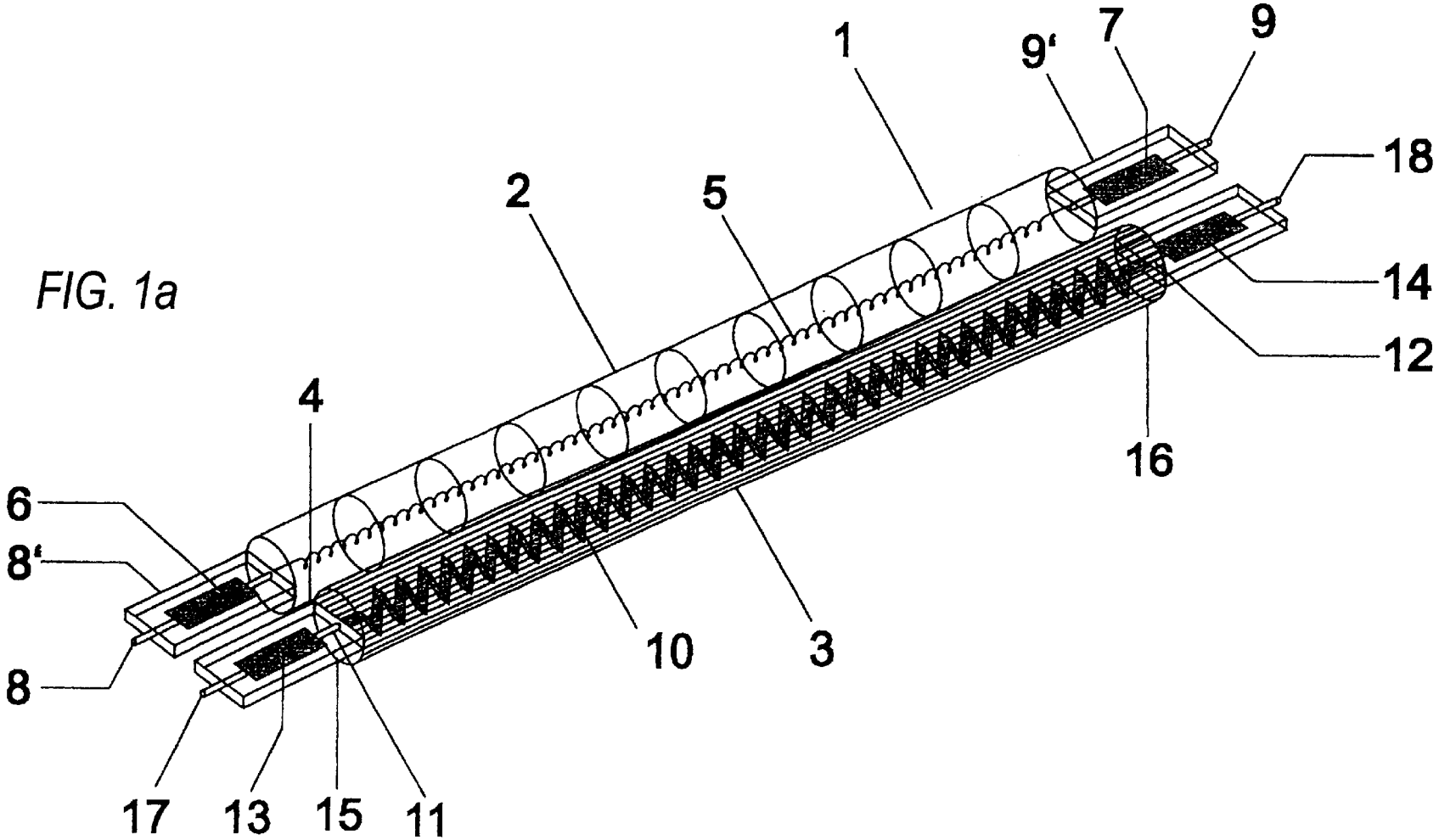

According to FIG. 1*a* the radiation system has a twin tube radiator 1 which contains two envelope tubes 2 and 3 arranged at least approximately parallel, made of material, preferably quartz glass, transparent to infrared radiation and visible radiation, the two tubes being permanently joined mechanically to one another by a middle section 4, which also consists of quartz glass. The first tube 2 has a short-wavelength infrared radiator provided with an incandescent coil 5 whose high radiation intensity is in the wavelength range of 780 nm to about 1.2 $\mu$m (near IR/IR-A), as it appears in the following FIG. 2 (curve II). The definition of the wavelength range is found in DIN Standard 5030, Part 2.

A similar radiator is disclosed, for example, in EP 0 428 835 and the corresponding U.S. Pat. No. 5,091,632, mentioned in the beginning. In a short-wavelength infrared radiator of this kind, the incandescent coil 5 of the envelope tube 2 in FIG. 1*a* is connected electrically and mechanically by leaf-like lead-throughs 6 and 7 of molybdenum in the pinched area of the ends 8' and 9' of tube 2 to external contacts 8 and 9, which serve for electrical connection to an external energy supply. The tube 3 has, however, an infrared radiator with a carbon ribbon as the radiating strip 10 which is connected by terminal contacts 11 and 12 and leaf-like lead-throughs 13 and 14 of molybdenum in the pinched areas of the tube ends 15 and 16 provided with external contacts 17 and 18 for connection to the energy supply.

The connection between the ends of the carbon ribbon 11 and the lead-throughs 13 and 14 is preferably made through graphite paper, as disclosed, for example, in DE 44 19 284 C2 and the corresponding U.S. Pat. No. 5,567,951. In this manner the electrical conductivity of the carbon ribbon expressed in the lengthwise direction is to be equalized when in contact with the lead-through. Furthermore, an improvement in cooling is also achieved.

Figure 1B:
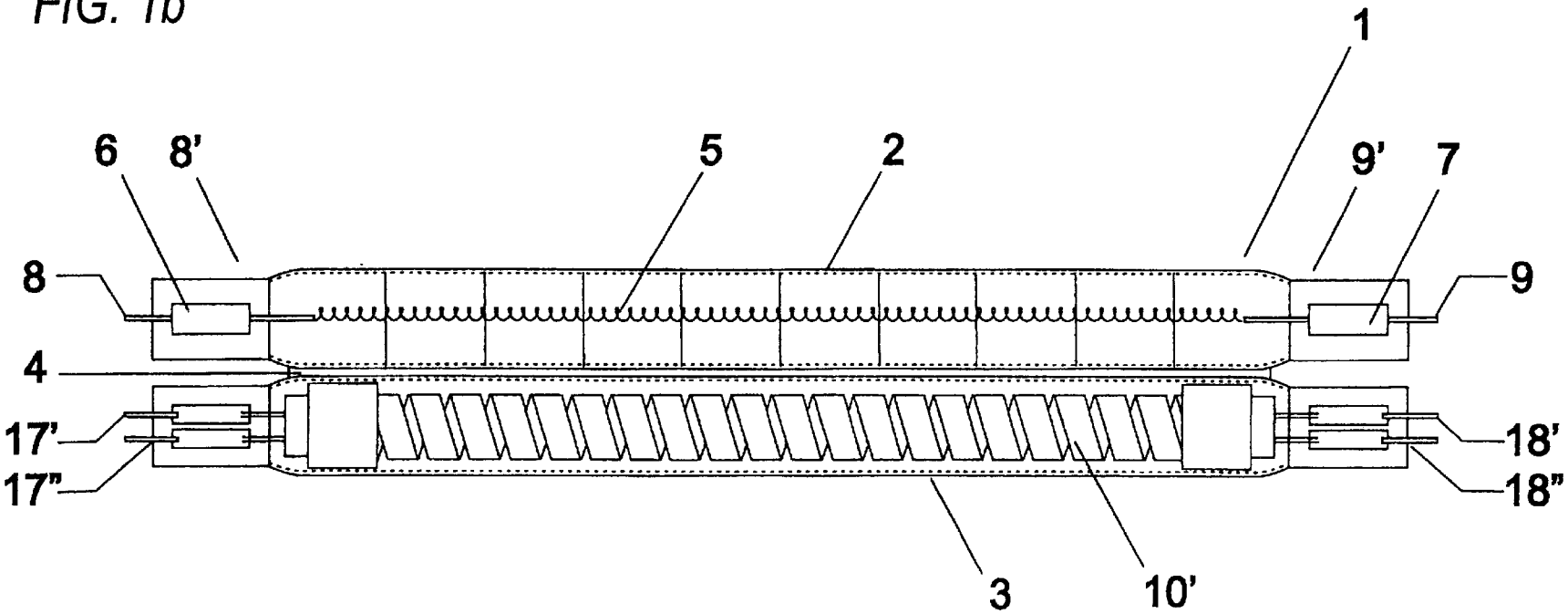

The front elevation in FIG. 1*b* shows the two envelope tubes 2 and 3 of the twin-tube radiator 1 lying side by side, which are joined together by a middle section 4 of quartz glass. In contrast to FIG. 1*a*, in which an elongated flat radiator ribbon 10 is shown, the radiator ribbon 10' of FIG. 1*b* is coiled before insertion into the carbon radiator, i.e., a coil in spiral form serves as the radiator ribbon 10'. The coiled radiator ribbon 10' has especially the advantage that a greater portion of the radiation in the wavelength range of 1.6 to 3.8 $\mu$m (near IR/R-B to medium IR/IR-C) according to curve I of FIG. 2 can be radiated, as a result of the Stefan-Boltzmann Law. The definition of the wavelength range is to be found in DIN Standard 5030, 2nd Part.

The envelope tubes 2 and 3 are—as already explained in connection with FIG. 1*a*—attached together mechanically by a middle section 4. The terminal contacts 8, 9, 17', 17" and 18', 18" are largely the same in their function as contacts 17 and 18 explained in FIG. 1. On account of the terminal contacts that are brought out each separately, individual operation of the lamps is possible, so that they can be operated simultaneously or in alternation.

Figure 1C:
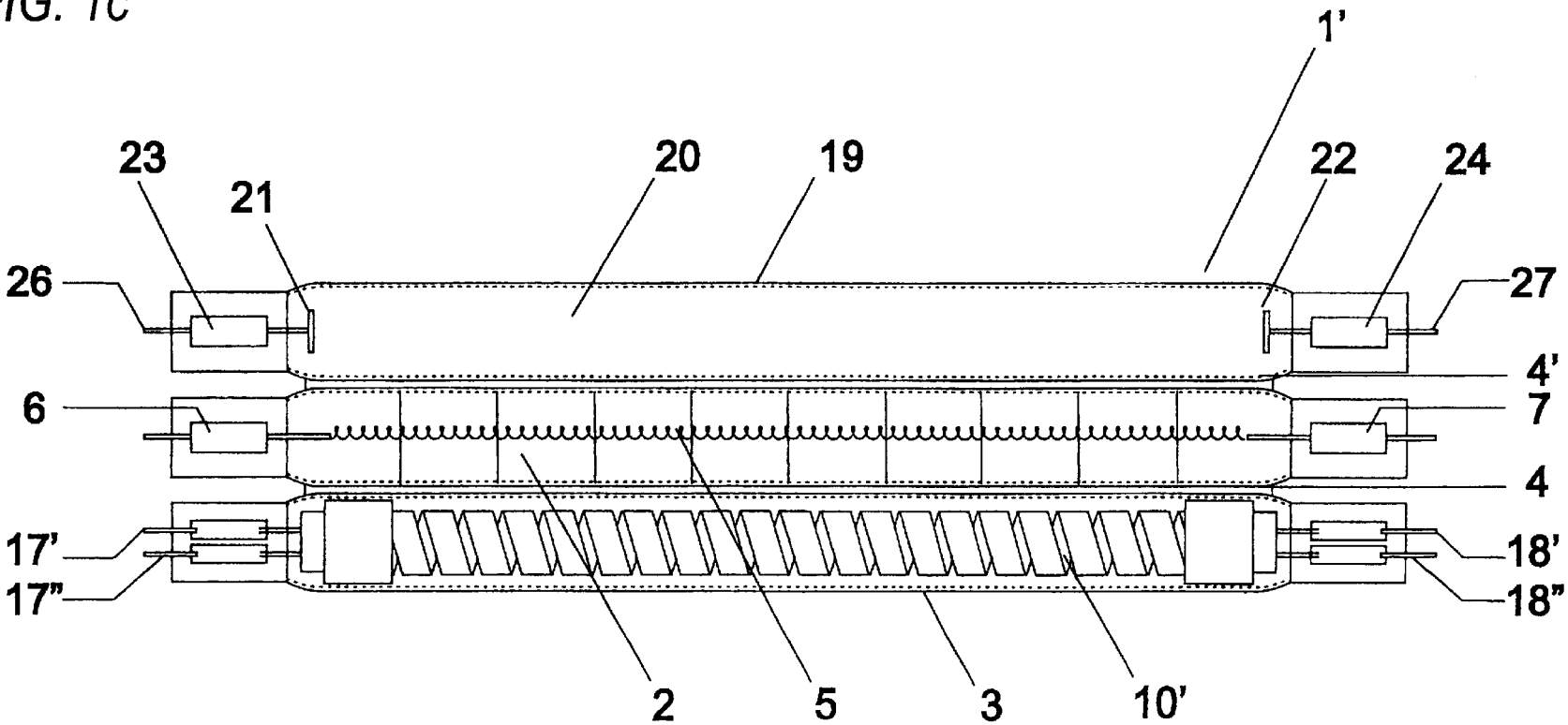

The front elevation of a combination radiator shown in FIG. 1*c* has, in addition to the previously described twin system, an additional radiator system in the form of a discharge lamp, wherein the quartz glass envelope tube 19 additionally joined by a middle section 4' (quartz glass) permits the emission of UV radiation. Since the discharge lamp 20 is joined to the twin-tube radiator system 1' by middle section 4', one can also speak of a triplet tube radiator system. It is thus possible to treat paint pigments with visible light and infrared radiation, and simultaneously or alternately to treat photoinitiators with UV radiation with discharge lamp 20. The filling of discharge lamp 20 consists preferably of mercury and, if desired, an admixture of metal halides, the electrodes 21 and 22 consisting preferably of tungsten. The power supply to discharge lamp 20 is provided through electrical current lead-throughs 23 and 24 which are preferably in the form of molybdenum foils. The additional envelope tube 19 of discharge lamp 20 consists, like middle section 4' and middle section 4, of quartz glass, thus providing optimum transparency for UV radiation. The terminal contacts 26 and 27 of discharge lamp 20 are also brought out separately, so that the discharge lamp 20 can be ignited and operated independently of the other two infrared radiators.

Thus it is possible to create a compact, universally usable radiator system, which on the one hand can be compactly stored and stocked, and on the other hand can be used in a variety of different functions.

Figure 2:
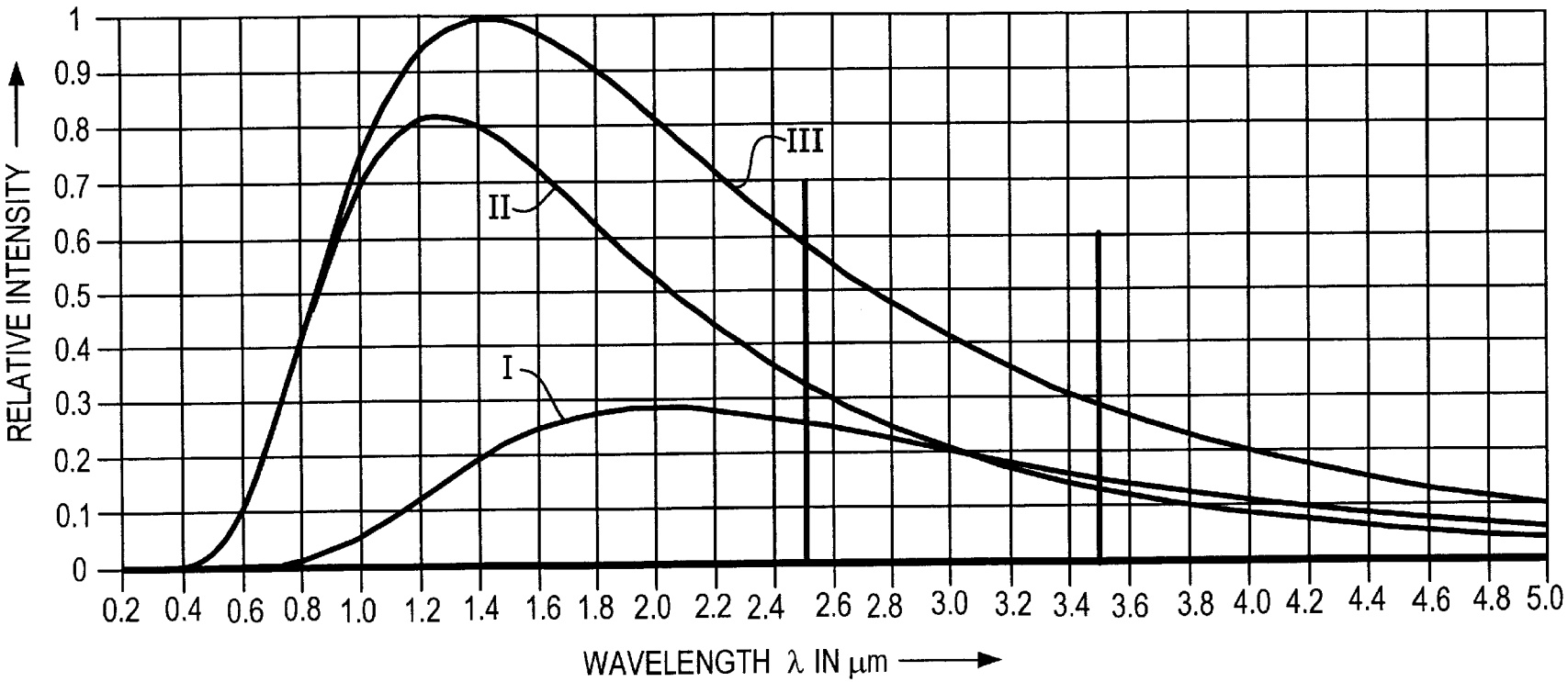
FIG. 2 shows in the diagram the relative intensity of a spectral radiation distribution according to Planck with $KW/m^2$ nomination with a short-wavelength infrared radiator (NIR/IR-A) at a working temperature of 2600° C. and a carbon radiator at a working temperature of about 950° C., the intensity being recorded over the wavelength $\lambda$ ($\mu$m).

As it can be seen in the diagram shown in FIG. 2, the relative peak intensity of a carbon radiator with a temperature of 950° C. (curve I) is in the range of 1.6 to 3.8 $\mu$m. In case of simultaneously operation of incandescent coil 5 (curve II) and carbon ribbon 10 or 10' as radiators, a thermal radiation source is formed by combining both radiators, which has a high total radiation content in the range from 780 nm to 3.5 μm according to curve III (near IR to the beginning of medium IR). Such a combination increases the efficiency of processes in which both paint pigments have to be dried, and corresponding solvents such as toluene or water must be removed from paints or varnishes by evaporation. It is thus possible with the dual radiator according to the invention to achieve short reaction times and high power densities in the short-wavelength infrared radiation sources.

In the case of an elevation of the temperature of the carbon ribbon 10 or 10' to 1200° C., it is possible to achieve a spectral radiation distribution similar to that represented in FIG. 2.

Figure 3:
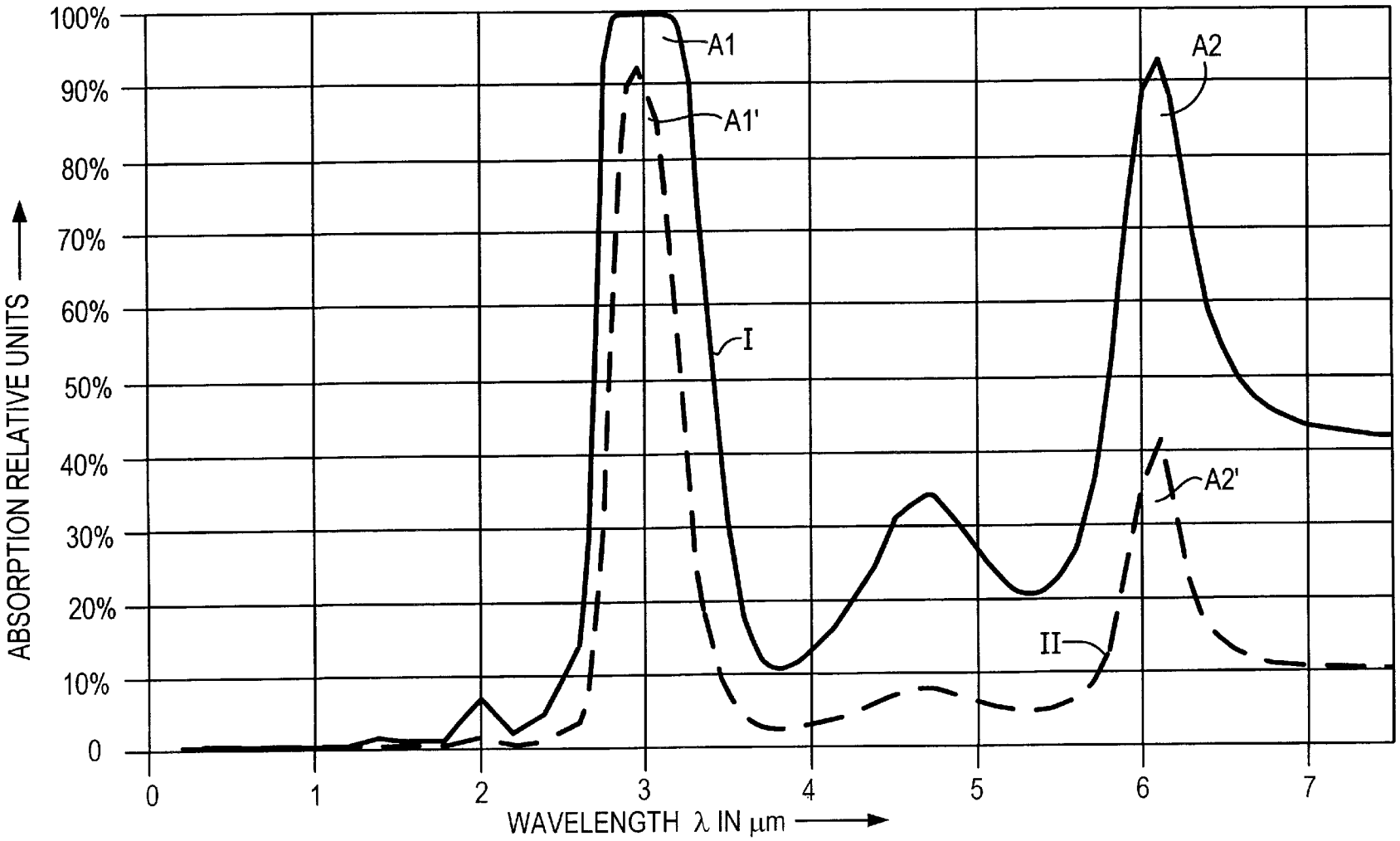
FIG. 3 shows in the diagram the spectral absorption of water for different water coat thicknesses (2 $\mu$m; 10 $\mu$m), the absorption in the range of 0 to 100 percent being recorded over the wavelength $\lambda$ in $\mu$m.

In FIG. 3 the diagram shows the spectral absorption of water, both for a greater thickness of 10 μm (curve I), for example, and for a lesser thickness of 2 μm (curve II), of the applied coat; a first maximum spectral absorption, marked A1 and A1', is in the wavelength range of about 3 μm, while a second, lesser maximum with an absorption of about 40 to 90 percent is in a spectral range of about 6 μm marked A2 and A2'. It can be seen that a coating thickness of only 2 μm has a lower degree of absorption at absorption points A1' and A2' of curve II, at 90 percent and 40 percent, respectively.

With the aid of FIG. 3 it can be seen that the maximum of the radiation required for the evaporation of water or other solvents is rather in the medium infrared range (IR-C/MIR per DIN 5030, 2nd Part), while drying of the paint pigments in FIG. 2 is performed successfully even in the short-wavelength range of 780 nm to about 1.2 μm (NIR/IR-A per DIN 5030, 2nd Part).

According to FIG. 4, the efficiency of the drying of water in a coating 10 μm thick is in a functional relationship with the temperature; at a temperature in the range of 1500 to 1200 the efficiency is in the range of 30 to 40 percent, while it decreases below 10 percent in the range of 3000 K and above. It can thus be seen that optimum efficiency in drying water is to be achieved in the range of 1000 to 1500 K.

Figure 4:
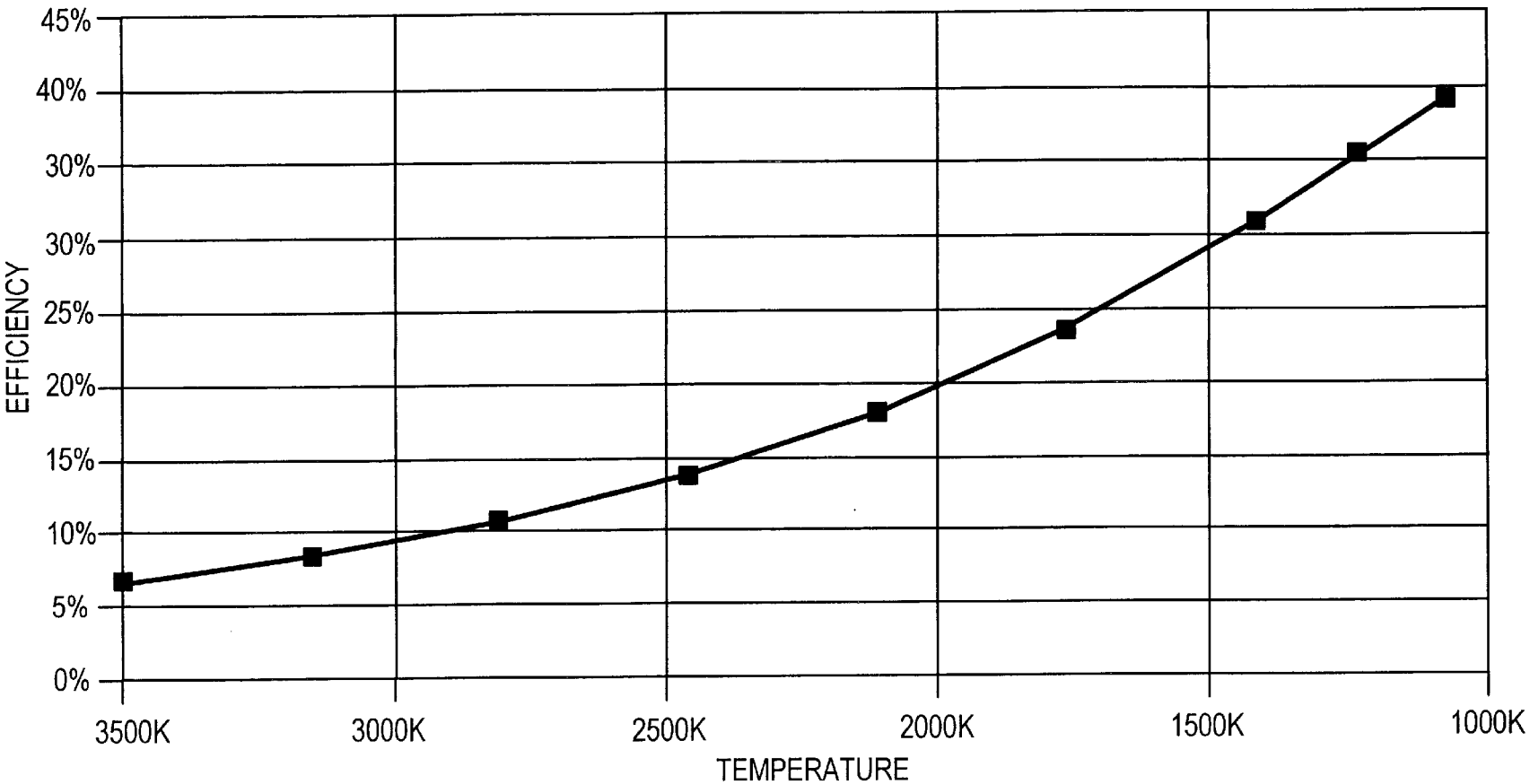
FIG. 4 shows in the diagram the efficiency of drying water for a water coat of 10 $\mu$m thickness, the temperature in Kelvin being recorded along the X axis, while the efficiency is recorded along the Y axis.
Figure 5:
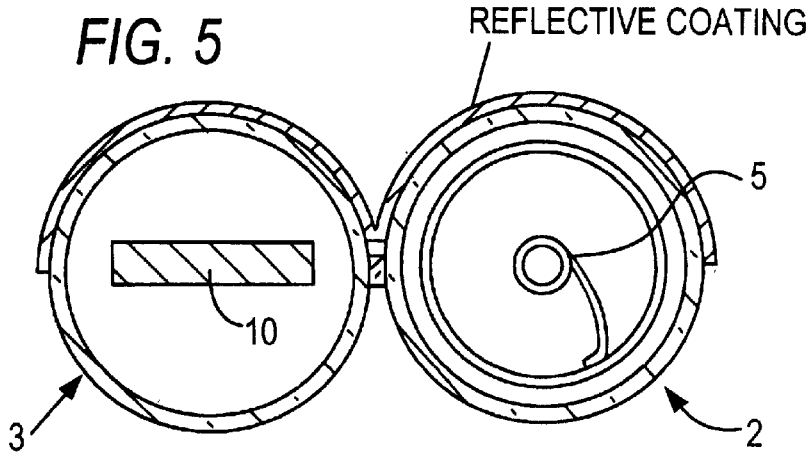
FIG. 5 is a cross section taken through a twin tube radiator according to FIG. 1*a*.
Figure 6:
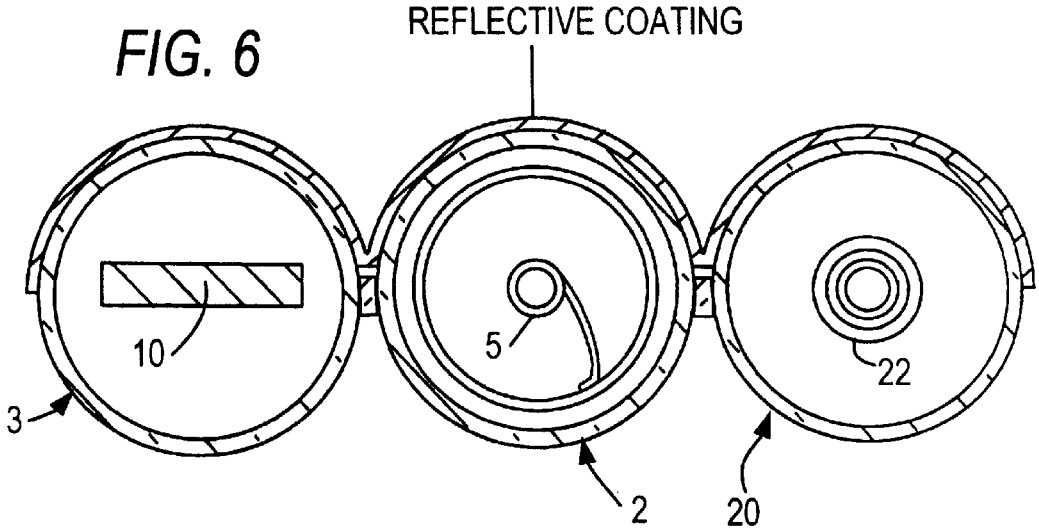
FIG. 6 is a cross section taken through a triple tube radiator according to FIG. 1*c*.

With the aid of FIGS. 2 to 4 it can thus be seen that, due to the simultaneous action of the short-wavelength infrared radiation from the incandescent coil in cooperation with the medium-wavelength infrared radiation by the carbon ribbon, very different requirements for the drying and evaporation of applied coatings or imprints are satisfied, so that a synergistic effect is produced by this kind of combination.

What is claimed is:

1. A method for the treatment of surfaces with an IR radiator comprising treating the same surface for a time with IR radiation from the IR radiator in a first wavelength range from 780 nm to 1.4 μm and at least for a time with an IR radiation from the IR radiator in a second wavelength range from 2.5 μm to 5 μm; wherein said IR radiator comprises at least two different IR radiation sources each located in an elongated envelope tube, wherein the tubes are connected parallel to each other and wherein at least one IR radiation source is made of an elongated carbon ribbon.

2. The method according to claim 1, wherein the IR radiation of the first and second wavelength range is superimposed for at least a time.

3. The method according to claim 1, wherein the IR radiation of the first wavelength range is emitted from an incandescent coil as IR radiation source and the IR radiation of the second wavelength range is emitted form the elongate carbon ribbon.

4. The method according to claim 1, wherein coated surfaces on substrates or dissolved paint pigments on a support are dried.

* * * * *